US008571762B2

(12) United States Patent
McAree et al.

(10) Patent No.: US 8,571,762 B2
(45) Date of Patent: Oct. 29, 2013

(54) REAL TIME METHOD FOR DETERMINING THE SPATIAL POSE OF ELECTRONIC MINING SHOVELS

(75) Inventors: Peter Ross McAree, St.-Lucia (AU); Anthony Walton Reid, Auchenflower (AU)

(73) Assignee: Ezymine Pty Limited, Pinjarra Hills, Qld (AU)

( * ) Notice: Subject to any disclaimer, the term of this patent is extended or adjusted under 35 U.S.C. 154(b) by 364 days.

(21) Appl. No.: 12/812,186

(22) PCT Filed: Jan. 7, 2009

(86) PCT No.: PCT/AU2009/000019

§ 371 (c)(1), (2), (4) Date: Jul. 8, 2010

(87) PCT Pub. No.: WO2009/086601

PCT Pub. Date: Jul. 16, 2009

(65) Prior Publication Data

US 2010/0283675 A1 Nov. 11, 2010

(30) Foreign Application Priority Data

Jan. 8, 2008 (AU) ..... 2008900081

(51) Int. Cl.
*G06F 7/70* (2006.01)

(52) U.S. Cl.
USPC ..... 701/50; 701/536; 701/408; 342/357.28

(58) Field of Classification Search
USPC ..... 701/223, 50, 213, 408, 536; 37/348; 414/685; 702/159; 706/52; 342/357.28
See application file for complete search history.

(56) References Cited

U.S. PATENT DOCUMENTS

| | | | | |
|---|---|---|---|---|
| 5,144,317 | A | 9/1992 | Duddek et al. | |
| 5,404,661 | A * | 4/1995 | Sahm et al. | 37/348 |
| 6,191,733 | B1 * | 2/2001 | Dizchavez | 342/357.57 |
| 6,418,364 | B1 * | 7/2002 | Kalafut et al. | 701/50 |
| 2005/0080559 | A1 * | 4/2005 | Ishibashi et al. | 701/213 |
| 2006/0230645 | A1 * | 10/2006 | McCain | 37/348 |
| 2007/0185681 | A1 * | 8/2007 | McKitterick | 702/159 |
| 2008/0097693 | A1 * | 4/2008 | McCain | 701/213 |
| 2009/0112472 | A1 * | 4/2009 | Montgomery | 701/223 |
| 2009/0187527 | A1 * | 7/2009 | Mcaree et al. | 706/52 |
| 2011/0311342 | A1 * | 12/2011 | Montgomery | 414/685 |

FOREIGN PATENT DOCUMENTS

DE 4133392 12/1992

OTHER PUBLICATIONS

International Search Report/Written Opinion completed Feb. 10, 2009 for PCT/AU2009/000019.

* cited by examiner

*Primary Examiner* — Thomas Black
*Assistant Examiner* — Shardul Patel
(74) *Attorney, Agent, or Firm* — Barnes & Thornburg LLP

(57) ABSTRACT

Knowing the global pose of mining excavators provides a range of benefits for managing and automating mining operations. A method for globally locating the pose of an electric mining shovel is described. The system takes measurements from an arbitrary number of RTK-GPS antennas mounted on the machine house and a resolver fitted to the machines' swing axis. A Kalman filter is used to produce estimates of the global locations pose.

12 Claims, 8 Drawing Sheets

$\lambda$ – Longitude $\phi$ – Latitude h – Elevation above WG584 ellipsoid $$b_1 \sin \omega t + \sum_{n=3,5,\ldots}^{\infty} b_n \sin n\omega t$$

$$b_1 = \frac{2AK}{\pi}\left[\sin^{-1}\left(\frac{a}{AK}\right) + \frac{a}{AK}\sqrt{1-\left(\frac{a}{AK}\right)^2}\right]$$

$$b_n = \frac{4AK}{\pi\left(1-n^2\right)}\left[\left(\frac{a}{AK}\right)\frac{\cos nB}{n} - \sqrt{1-\left(\frac{a}{AK}\right)^2}\sin nB\right]$$

$$B = \sin^{-1}\left(\frac{a}{AK}\right)$$

REAL TIME METHOD FOR DETERMINING THE SPATIAL POSE OF ELECTRONIC MINING SHOVELS

CROSS-REFERENCE TO RELATED APPLICATIONS

This application is the U.S. national phase of PCT/AU2009/000019 filed Jan. 7, 2009. PCT/AU2009/000019 claims priority to Australian patent application 2008900081 filed Jan. 8, 2009. The disclosures of both AU 2008900081 and PCT/AU2009/000019 are hereby incorporated herein by reference

FIELD OF THE INVENTION

The present invention relates to the field of positioning of equipment and, in particular, discloses a system for determining the spatial pose of swing loading equipment utilised in mining operations such as electric mining shovels.

REFERENCES

Department of the Army, 1993, FM 6-2. *Tactics, Techniques, and Procedures for Field Artillery Survey*, Department of the Army, Washington D.C.

Dizchavez, R. F., 2001, *Two-antenna positioning system for surface-mine equipment*, U.S. Pat. No. 6,191,733

Gelb, A., 1996, *Applied optimal estimation*, The M.I.T. Press, Cambridge

Kalafut, J. J., Alig, J. S., 2002, *Method for determining a position and heading of a work machine*, U.S. Pat. No. 6,418,364

Pike, J., 2006, 'World Geodetic System 1984', [Online] Available at: http://www.globalsecurity.org/military/library/policy/army/fm/6-2/fige-1.gif Sahm, W. C. et al., 1995, *Method and apparatus for determining the location of a work implement*, U.S. Pat. No. 5,404,661

Tu, C. H. et al., 1997, *GPS compass: A novel navigation equipment*, IEEE Transactions on Aerospace and Electronic Systems, 33, 1063-1068.

Vaniceck, P., Krakiwsky, E., 1986, *Geodesy: The concepts*, Elsevier Science Publishers B. V., Amsterdam.

Gelb, A. and Vander Velde, W. E., *Multiple-Input Describing Functions and Nonlinear System Design*, McGraw-Hill Book Company, New York (1968).

Graham, D. and McRuer, D., Analysis of Nonlinear Control Systems, John Wiley & Sons Inc, New York (1961).

Duddek et al. 1992; Method of determining mining progress in open cast mining by means of satellite geodesy, U.S. Pat. No. 5,144,317.

BACKGROUND OF THE PRESENT INVENTION

Various solutions to the problem of determining the position and orientation of mobile equipment units have been previously proposed. Solutions invariably take advantage of a variety of localization sensors, including some of those given above.

Duddek et al. (1992) discloses a method of determining the position and orientation of the end of a excavator bucket utilising GPS sensors and a receiver in the vicinity of the bucket wheel.

Kalafut et al. (2002) proposes a system by which the position and heading of a machine can be determined through the use of a single positioning sensor. Readings are taken from the positioning sensor over time, and a motion profile is generated to estimate the heading of the machine. This approach is particularly applicable to machines that are commonly in motion, and have well-defined dynamic characteristics. In a mining application, haul trucks are a good candidate for this type of approach, so long as they are in motion.

Another example of a single-sensor positioning system is that proposed by Sahm et al. (1995) which uses a single sensor, capable of collecting (x, y, z)-position measurements connected to the boom of a mining shovel. If the shovel's undercarriage is assumed to be stationary during a dig cycle, then a set of points can be measured over time to generate the plane in which the sensor exists. This estimate, along with the current measurement of position from the sensor, can be used to estimate the current position of the shovel bucket.

The method of localizing from an estimated plane is further explored by Dizchavez (2001). Two GPS antennas are mounted on the machine house at known locations of equal elevation. During the operation of the machine, rotation of the house can be measured, and using calculations based on standard-deviation analysis, an estimate of the plane in which the two antennas lie is formed. From this plane, and the current position and orientation of the sensors within the plane, another part of the machine can be localized given a kinematic model and appropriate joint position information.

It is desirable to provide an improved method and apparatus for determining the spatial pose of mining equipment or the like.

Any discussion of the prior art throughout the specification should in no way be considered as an admission that such prior art is widely known or forms part of common general knowledge in the field.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

SUMMARY OF THE PRESENT INVENTION

In accordance with a first aspect of the present invention, there is provided a method of determining the global pose of a mining shovel, the method including the step of applying a multi stage calculation, including: (a) as a first stage computing the location of the mining shovel carbody (c-frame) relative to a local geodetic frame (g-frame) utilising a global positioning system, an inclinometer, and a swing axis resolver; (b) as a second stage computing a house pose (h-frame) relative to the c-frame using a global positioning system, an axis inertial sensor and a swing axis resolver. (c) as a third stage computing a bucket pose (b-frame) relative to the h-frame using crowd and hoist axis resolvers.

The steps (a) and (b) are preferably carried out utilising an extended Kalman filter. The step (a) can be carried out utilising an iterative routine until convergence. The inclinometer can be a twin axis inclinometer. The inertial sensor can be a six axis inertial sensor. The first portion of the shovel can comprise the machine house.

In accordance with a further aspect of the present invention, there is provided a method determining the global pose of electric mining shovels as a three stage calculation process which: (a) at a first stage computes the location of the carbody (c-frame) relative to a local geodetic frame (g-frame) utilising a global positioning system, an dual axis inclinometer, and a swing axis resolver until convergence; (b) at a second stage computes the house pose (h-frame) relative to the c-frame using a global positioning system, a six axis inertial sensor (three rate gyroscopes and three linear accelerations) and a swing axis resolver; (c) at a third stage computes the bucket pose (b-frame) relative to the h-frame using crowd and hoist axis resolvers.

In accordance with another aspect of the present invention, there is provided a method for determining the global spatial pose of a mining shovel, the method comprising the steps of (a) designating a first Earth-Centred-Earth-Fixed (ECEF) frame or e-frame of reference; (b) designating a local geodetic coordinate frame, denoted a g-frame, in the vicinity of the mining shovel, defined as a set of Cartesian coordinate axes in the e-frame; (c) designating a set of Cartesian coordinate axes, denoted a c-frame, in the close vicinity to the carbody or under-carriage of the mining shovel; (d) determining the location of the c-frame within the g-frame; (e) designating a set of Cartesian coordinate axes, denoted a h-frame, in the vicinity of the machine house of the mining shovel; (1) determining the location of the h-frame within the c-frame; (g) designation a set of Cartesian coordinate axes, denoted the b-frame, fixed to the close vicinity of the shovel handle and dipper assembly; and (h) determining the location of the b-frame within the h-frame.

BRIEF DESCRIPTION OF THE DRAWINGS

Preferred forms of the present invention will now be described with reference to the accompanying drawings in which.

PREFERRED AND OTHER EMBODIMENTS

Figure 8:
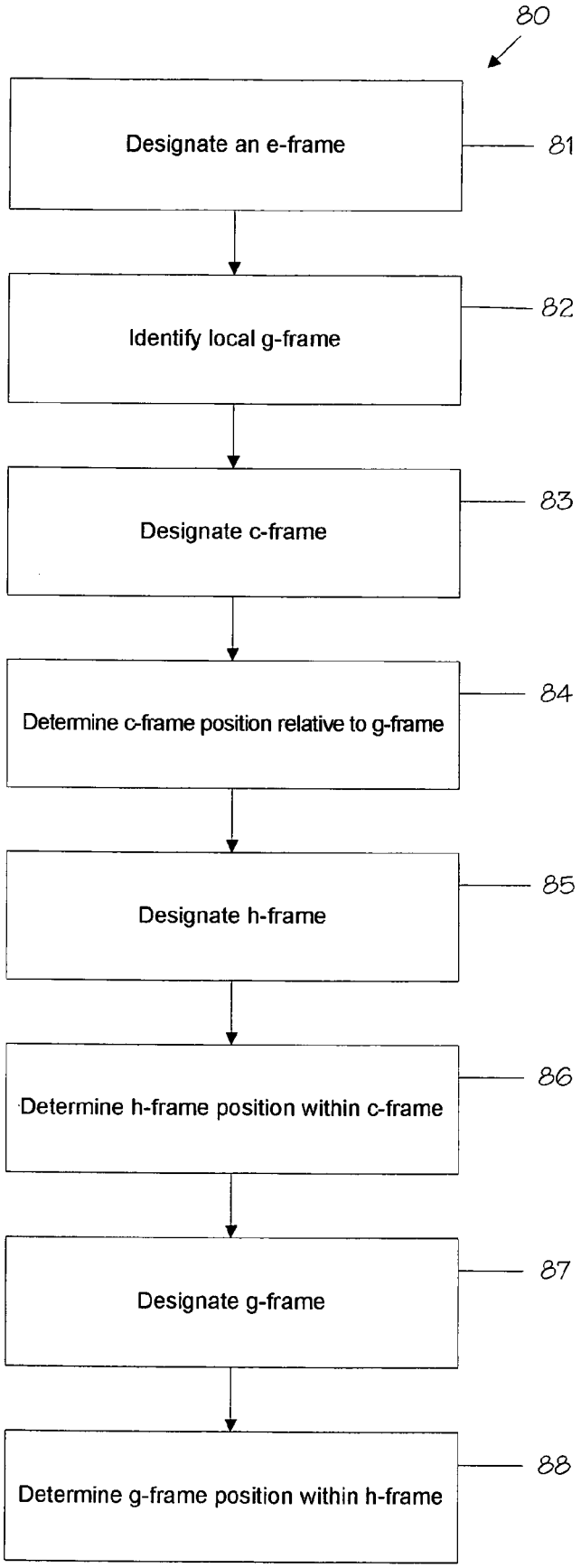
FIG. 8 illustrates a flow chart of the steps of the method of the preferred embodiment.

As illustrated in FIG. 8, the preferred embodiments provide an improved method 80 for determining the global spatial pose of an electric mining shovel. The global spatial pose includes

- The designation of an Earth-Centred-Earth-Fixed (ECEF) frame or e-frame 81;
- The identification of a local geodetic coordinate frame (g-frame) defined as a set of Cartesian coordinate axes in the e-frame and aligned, for example, with the North, East and Down convention. The origin of this frame is somewhere near to the mining shovel, typically within the mine property at which the machine is located 82;
- The designation of a set of Cartesian coordinate axes fixed to the carbody or under-carriage of the mining shovel 83. The Cartesian frame defined by these axes is to be known as the c-frame;
- The determination of the location (position and orientation) of the c-frame within the g-frame 84;
- The designation of a set of Cartesian coordinate axes fixed to the machine house of the mining shovel. The Cartesian frame defined by these axes is to be known as the h-frame 85;
- The determination of the location (position and orientation) of the h-frame within the c-frame 86;
- The designation of a set of Cartesian coordinate axes fixed to the shovel handle and dipper (bucket) assembly 87. The Cartesian frame defined by these axes is to be known as the b-frame;
- The determination of the location (position and orientation) of the b-frame within the h-frame 88.

Collectively these coordinate definitions enable the location of the bucket to be established in global coordinate frame.

Figure 1:
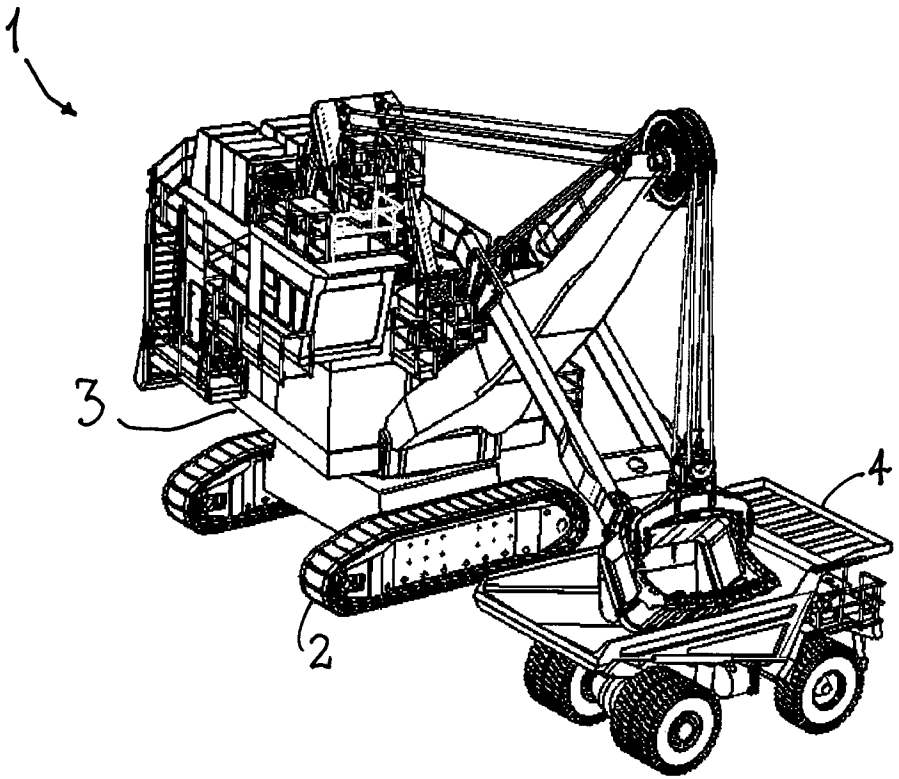
FIG. 1 illustrates an electric mining shovel loading a haul truck.

As shown in FIG. 1, a basic characteristic in the operation of a mining shovel 1 and other similar excavators is that they maintain the location of the c-frame for many minutes at a time. That is to say, repositioning the machine using the crawler tracks 2 is done infrequently and between moves the main activity is the back-and-forth swinging motion of the machine house 3 as the excavator sequentially digs material and loads the material into haul trucks 4.

The preferred embodiment exploits such operational characteristics of mining shovels 1 to address the problem of determining the pose of the shovel.

The preferred embodiment also exploits the combinations of several available complimentary sensor measurements, including

- Real-Time Kinematic Global Position System (RTK-GPS) measurements in the e-frame of the position of one or more identified points fixed to the h-frame;
- Inertial measurements made of three orthogonal accelerations and three orthogonal angular rates of the h-frame relative to the g-frame;
- Inclinometer measurements of the pitch and roll of the h-frame relative to the g-frame;
- Speed and position measurements of the three primary motion actuators, namely the swing, crowd, and hoist motors;
- Voltage and current measurements from the three primary motion actuators, namely the swing, crowd, and hoist motors;
- Reference values set by the shovel operator, usually through joysticks, that are inputs to the control systems of the three primary motion actuators, namely the swing, crowd and hoist motors.

The preferred embodiment presents a formulation of a recursive algorithm based on the extended Kalman filter that determines the global shovel pose using combinations of these measurements.

Knowing shovel pose in real-time is useful for several purposes, which include

1. An application for which commercial systems already exist uses knowledge of the position of the dipper during digging, relative to the resource map, as a means for allowing the operator to distinguish ore from waste;
2. An application of emerging importance is for automation of mining equipment where an important problem requiring solution is controlling interactions with other equipment such as haul trucks. If such equipment units are equipped with similar pose estimation capabilities, the relative pose between equipment can be determined;
3. Knowledge of shovel pose is also needed for proper spatial registration of data from scanning range sensors, e.g. laser scanners and mm-wave radar as might be used for ranging in automation systems and for the development of local digital terrain maps.

The prior art solutions ignore the estimation theory that can be adapted to the estimation problem. Specifically, it is possible to formulate the problem as a state estimation exercise, in which the relative positions and orientations of the g-, c-, h- and b-frames can be expressed as the states of a dynamic system and knowledge of the causal relationship (the 'process model') between the measured operator command references and the resulting motion of the machine is used to propagate current knowledge of shovel pose (in the form of a probability distribution) forward in time to facilitate fusion with a combination of measurements from the sensors identified previously.

Problem Formulation

Figure 2:
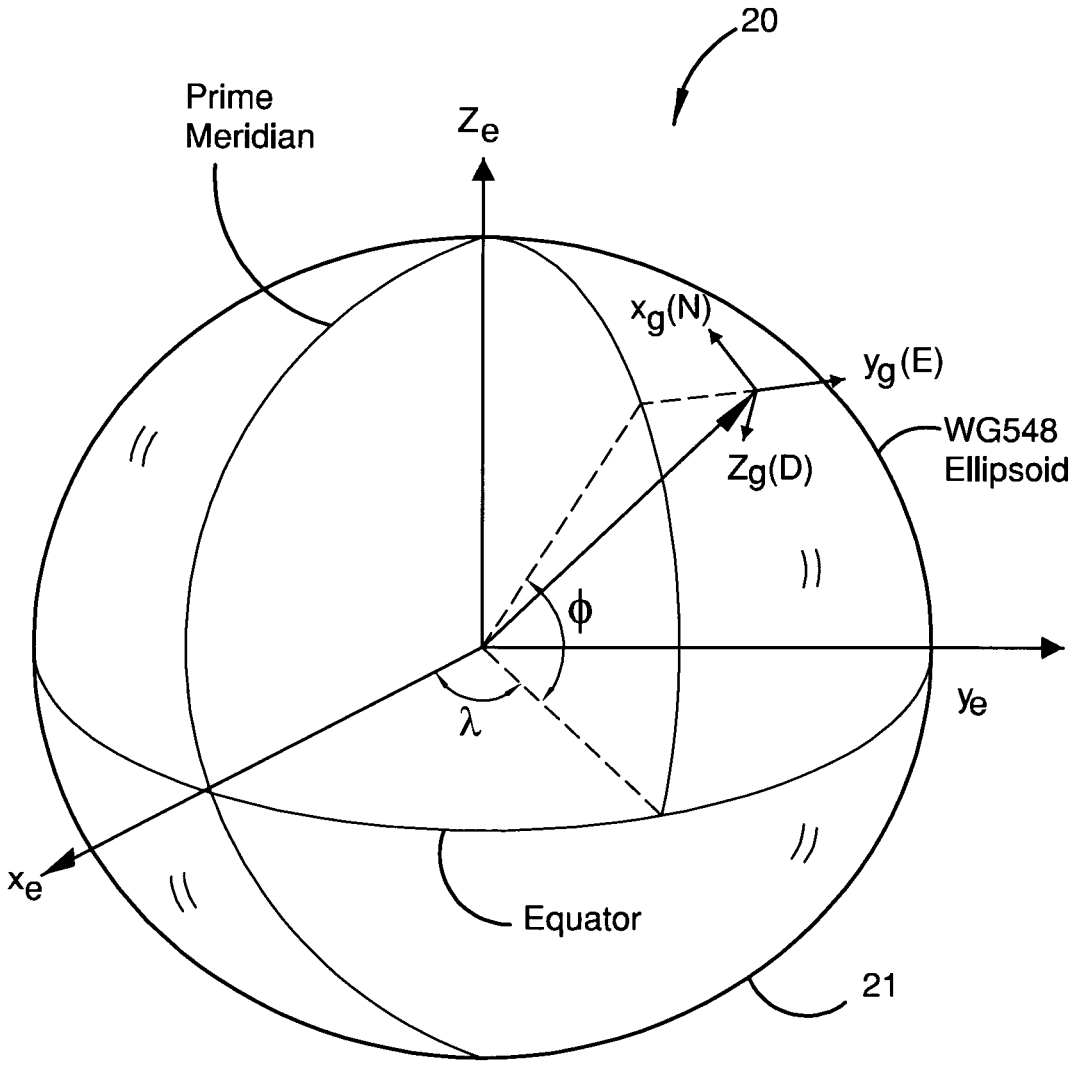
FIG. 2 illustrates the definitions of e-frame and the g-frame.
Figure 3:
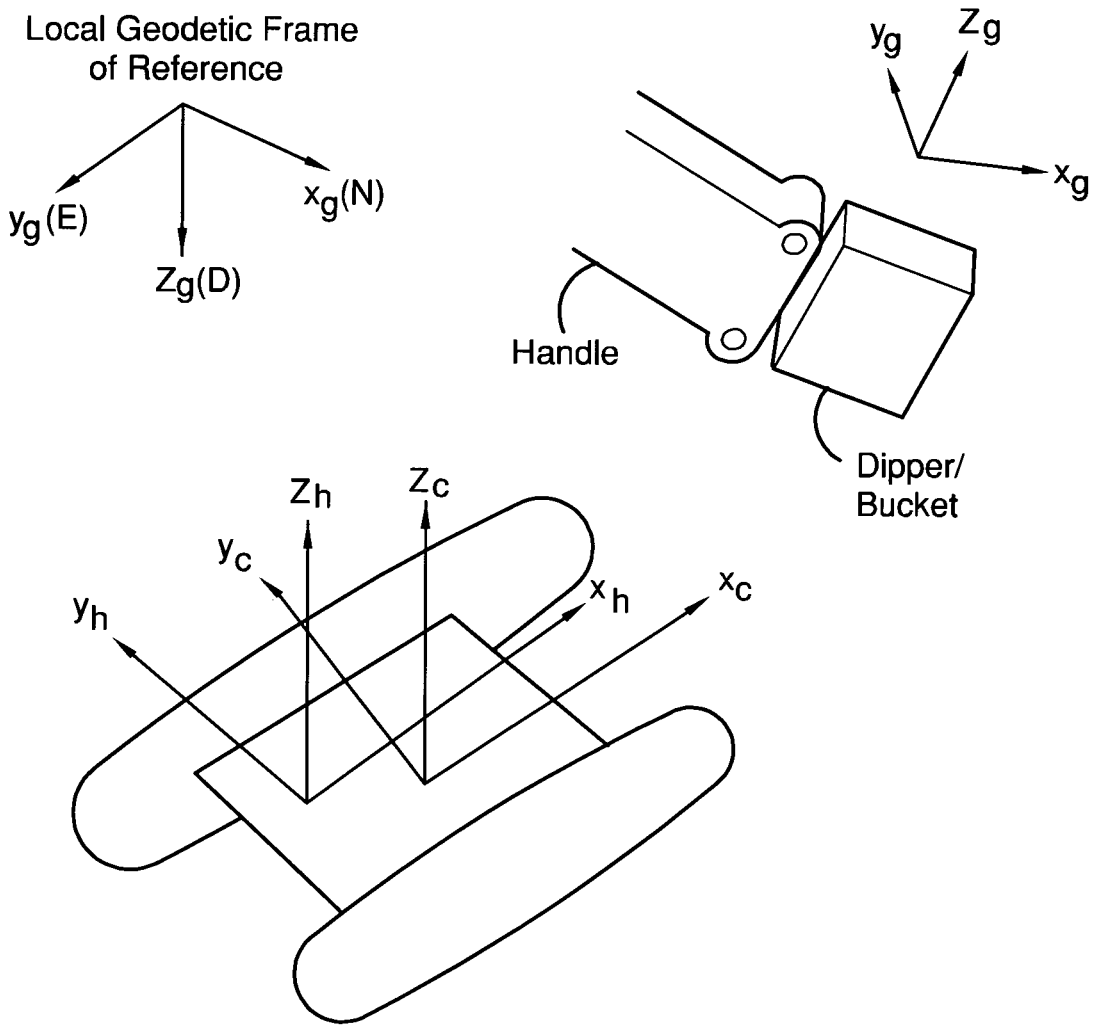
FIG. 3 illustrates the definitions of the c-frame, h-frame, and b-frame

The geometry relevant to the problem including the various coordinate frames are shown in FIGS. 2 and 3. Turning initially to FIG. 2, there is shown the geometry frames for locating the earth frame (e-frame) and geodetic coordinate frame (g-frame) relative to the earth 21. FIG. 3 illustrates the car body frame (c-frame), the house frame (h-frame) and the bucket frame (b-frame).

The pose of the shovel bucket is computed in two stages.

The objective in the first stage is to compute the location of the c-frame relative to the h-frame from the following measurements

- the positions in the g-frame of n RTK-GPS receivers;
- the apparent orientation of the $z_h$-axis relative to the $z_g$-axis, as measured by a dual-axis inclinometer fixed in the h-frame;
- the rotation of the h-frame about the $z_c$-axis;
- the angular velocity of the swing motor;
- the armature current and armature voltage of the swing motor;
- the operator command references from joysticks.

These quantities define a measurement vector z and an input vector u.

The objective in the second stage is, having found the location of the c-frame relative to the g-frame, to compute the location of the h-frame relative to the c-frame using the following measurements

- the positions in the g-frame of n RTK-GPS receivers;
- measurements of the angular rates and linear accelerations in three orthogonal directions of a point fixed in the h-frame but measured in an inertial frame which is instantaneously aligned with the orthogonal sensor axes;
- the rotation of the h-frame about the $z_c$-axis;
- the angular velocity of the swing motor;
- the armature current and armature voltage of the swing motor;
- the operator command references from joysticks.

These quantities define a second measurement vector z and a second input vector u.

The objective in the third stage is to compute the location of the b-frame relative to the h-frame using the following measurements

- Position of the hoist motor
- Position of the crowd motor and a kinematic model of the digging assembly. The Stage 3 calculations are kinematic and compute the location of the b-frame relative to the h-frame.

The calculation process to determine shovel pose is at follows

- Immediately after the machine has completed any propel motion and entered normal digging activity, characterized by repetitive to-and-fro swinging, the first stage calculations are run for a sufficient time to obtain a converged estimate for the location of the c-frame relative to the g-frame. The location of the g-frame with respect to the e-frame is assumed to be a priori known;
- After convergence has been obtained at Stage 1, the second and then third stages of calculations are initiated and made at regular time steps to determine the position of the h-frame relative to the c-frame and the b-frame relative to the h-frame;
- When the operator next propels the machine, calculations cease until completion of the propelling motion whereupon the first stage calculations are again executed to find a new converged estimate for the location of the c-frame relative to the g-frame. The calculations then move to Stage 2, and so forth.

Underpinning this staged calculation process is the idea that the measurements used at Stage 1 can provide rich information about the low frequency motions of the machine sufficient to accurately determine the position of the c-frame relative to the g-frame. During the normal to-and-fro motion associated with normal production, in addition to large scale swing motion, there is the potential for the machine house to undertake smaller amplitude rocking motions, particularly during digging. The sensor measurements used at Stage 2 aim towards accurate determination of these motions. In this sense, the Stage 2 filter aims towards a higher bandwidth of estimation.

The methodology for the calculation of Stages 1 and 2 is the extended Kalman filter (EKF), Gelb (1974), The EKF requires a system model of the form $$\dot{x}=f(x,u,t)+w,\ w\sim N(0,Q)$$

$$z_k=h(x_k,u_k,k)+v_k,\ v_k\sim N(0,R) \tag{1}$$

where f(x,u,t) is a vector-valued function describing the dynamics of the system that is used to propagate the current estimate of state and state covariance forward in time based on measurement of the operator command reference, so it can be combined with newly obtained measurement data. The vector-valued function $h(x_k,u_k,k)$ expresses the measurements in terms of the state vector x and inputs u.

The EKF requires linearization of f(x,u,t) and $h(x_k,u_k,k)$ about the estimated state trajectory $\hat{x}$ and the conversion of the linearized continuous dynamics to a discrete time form. It is desirable to use the following notation:

$$F=\exp\left(\frac{\partial f(x,t)}{\partial x}\Delta t\right) \tag{2}$$

where Δt is the measurement update rate and $$\nabla h_k=\frac{\partial h(x_k,k)}{\partial x_k}\Big|_{x_k=\hat{x}_k} \tag{3}$$

The vectors w and v in Equations 1 are termed the process and measurement noise and are assumed to be generated by zero mean, Gaussian processes with covariances Q and R respectively.

The computational scheme of the EKF involves the following five steps (Gelb, 1974):

1. State estimate propagation $$x_{k+1}^-=F\hat{x}_k^+ \tag{7}$$

2. State covariance propagation $$P_{k+1}^-=FP_k^++P_k^+F^T+Q \tag{8}$$

3. Calculation of the Kalman gain $$K_{k+1}=P_{k+1}^{-}\nabla h_{k+1}^{T}(\nabla h_{k+1}P_{k+1}^{-}\nabla Vh_{k+1}^{T}+R)^{-1} \quad (9)$$

4. State estimate update $$\hat{x}_{k+1}^{+}=\hat{x}_{k+1}^{-}+K_{k+1}(z_{k+1}-h(\hat{x}_{k+1}^{-},k)) \quad (10)$$

5. Error covariance update at time step k $$P_{k+1}^{+}=(I-K_{k+1}\nabla h_{k+1})P_{k+1}^{-} \quad (11)$$

Equations 7 to 11 define the EKF algorithm which provides the best linear state estimator for a non-linear system measured by the minimum mean squared error. The superscripts '−' and '+' in Equations 7 to 11 indicate evaluation of quantities before and after a measurement has been made.

Form of Dynamic Models

The dynamic model used for propagation of shovel pose in Stages 1 and 2 includes, as a common element, a causal model relating operator joystick reference to swing motions within the vector-valued function f (x,u,t). The preferred embodiment of this model for Centurion enables P&H shovels is given below.

P&H Centurion enabled electric mining shovels use an ABB DCS/DCF600 Multi-Drive controller to regulate motor speed, armature current and field current in each of the three DC motors. The controller is made up of four integral components; a PID or PI motor speed control loop, an armature current saturation limiter, a PI current control loop and an EMF-field current regulator.

Figure 4:
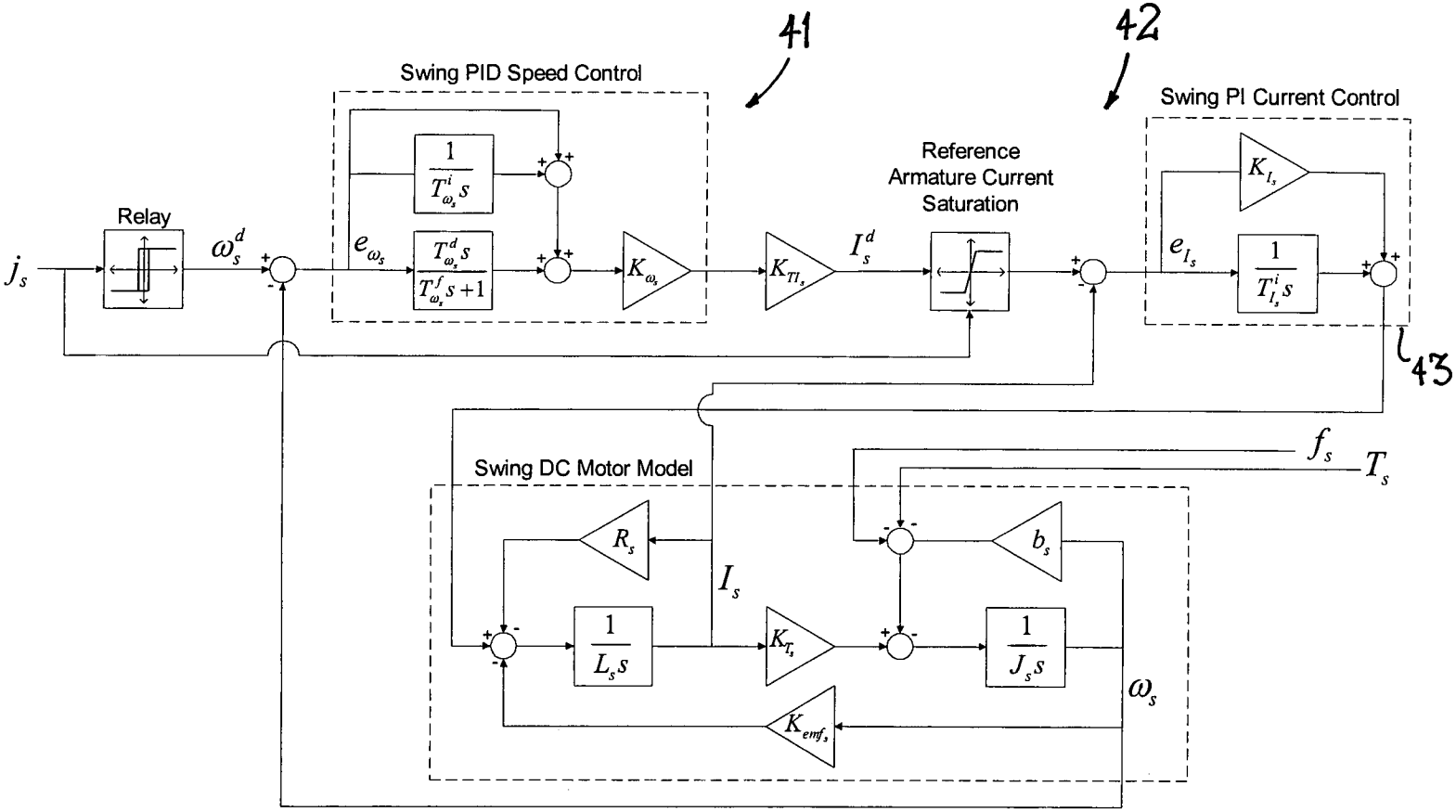
FIG. 4 illustrates the control system on the swing axis for P&H Centurion controlled shovels.

The swing drive uses a combination of torque control and bang-bang speed control, where by the swing joystick position generates a piecewise speed reference and an armature current saturation limit. A schematic of the swing drive model is shown in FIG. 4. The difference between the reference and actual swing motor speed feeds the Proportional-Integral-Derivative (PID) speed controller 41 incorporating derivative filtering. The output of the speed controller is scaled 42 into a reference armature current that is limited proportionally according to the amplitude of the swing joystick reference. The error between the limited current reference and the actual armature current feeds into a PI current controller 43 that outputs an armature voltage to the swing motor. Like the crowd drive, the swing motor has a constant field current with the DCF600 maintaining the field voltage at a steady level.

Modelling the shovel's drives effectively requires a means for incorporating the non-linear saturation effects seen in the motor armature currents. To include these effects into the prediction models a sinusoidal input describing function is used. The describing function, which will be abbreviated to DF, was developed primarily for the study of limit cycles in non-linear dynamic systems, see Gelb and Vander Velde (1968), and Graham and McRuer (1961). The basic idea of the describing function approach is to replace each non-linear element in a dynamic system with a quasi-linear descriptor or describing function equivalent gain whose magnitude is a function of the input amplitude.

Figure 5:
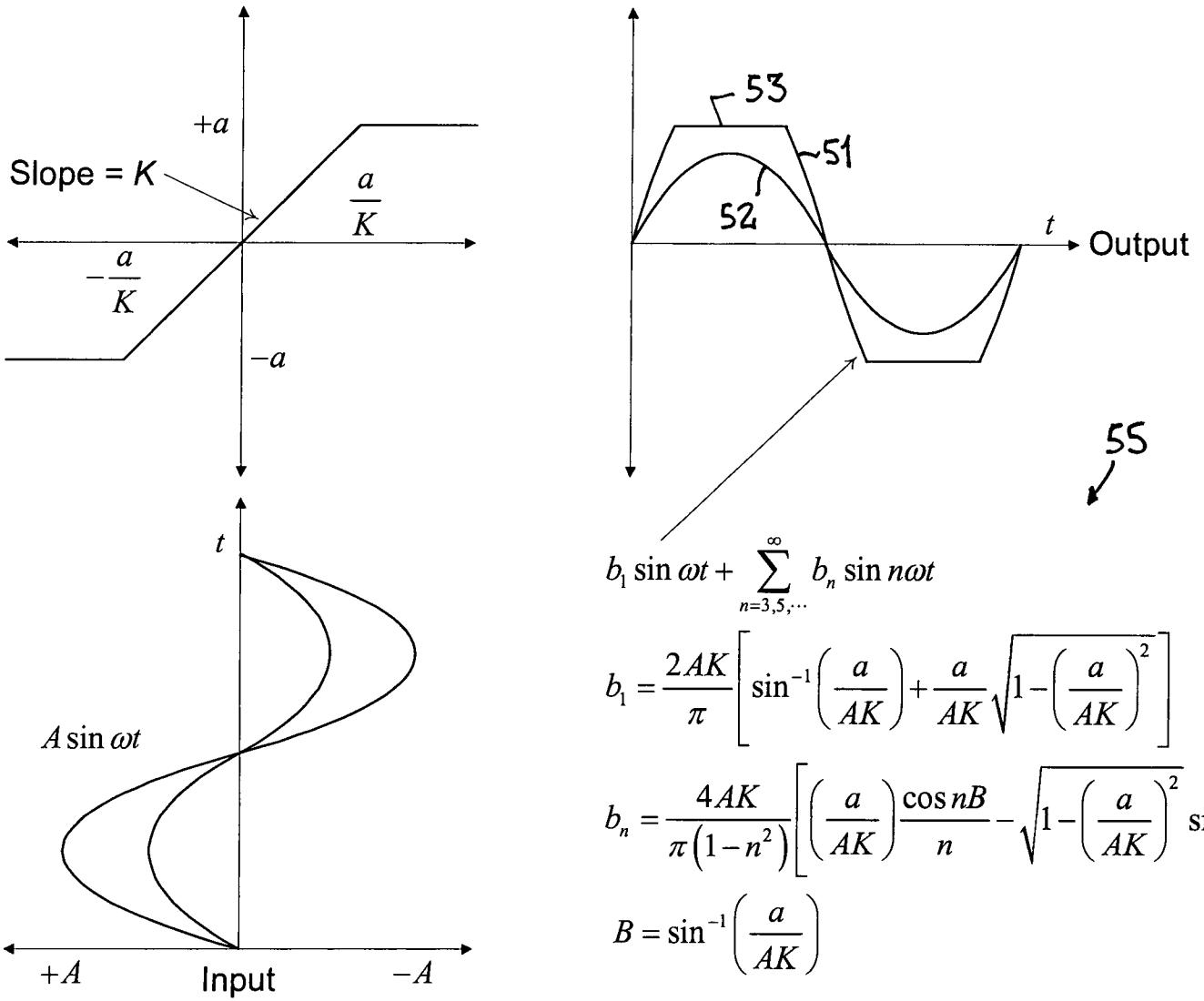
FIG. 5 illustrates the characteristics of saturation type non-linearities including the describing function gain as a function of the input.

Armature current saturation is modelled using a DF equivalent gain for sinusoidal saturation. FIG. 5 illustrates the effect of a saturating amplifier on a sine wave input. For inputs to the amplifier with amplitudes less than the saturation limit (a/AK>1) the output 51 is proportional to the input. For inputs with amplitudes greater than the saturation limit (a/AK<1) the output 53 becomes "clipped" and can be expressed by a Fourier series 55, where the terms $b_3 \sin 3\omega t$, $b_5 \sin 5\omega t$, etc, represent new frequencies generated by the non-linear saturation element. The DF approach to modelling this saturation assumes that the higher order terms in the saturated output are negligible. A DF equivalent gain for sinusoidal saturation thus takes the form $$G=\frac{b_1}{A}=\frac{2K}{\pi}\left[\sin^{-1}\left(\frac{a}{AK}\right)+\frac{a}{AK}\sqrt{1-\left(\frac{a}{AK}\right)^2}\right]$$

where b, is the first or fundamental term of the output's Fourier series and A is the amplitude of the input.

Implementing the DF into the prediction models requires the equivalent gain to be evaluated at each time step. If the input to the current saturation block is larger than the saturation limit, the saturated output is calculated by multiplying input magnitude by the equivalent gain.

The assumption that the higher order terms of the saturated output's Fourier transform are not dominant can be supported by the notion that the shovel's drive dynamics act as low pass filters and the fundamental frequency of the output is much less attenuated in passing through the system than the output's higher order harmonics.

The drive prediction models are presented as continuous, linear state space systems with the form $$\dot{x}=Ax+Bu.$$

The input vector u, contains the reference motor speeds $\omega_s^d$ generated from the joystick signals, the static torque load on the motor due to gravitational effects $T_s$ and a coulomb friction disturbance input $f_s$. The state vector x, for each model, contains swing armature current $I_s$, the swing motor speed $\omega_s$, the swing motor position $\theta_s$, and the integrals of the error in the speed and current controllers, $\int e_{\omega_s}$, and $\int e_{I_s}$.

The swing drive model also contains the swing reference armature current prior to the saturation limit $I_{s_{ref}}$. This state arises from the derivative component in the swing $I_S$ motor speed controller. The full state space models for the swing drive is given by $$\begin{bmatrix} \dot{I}_s \\ \dot{\omega}_s \\ e_{I_s} \\ \dot{I}_{s_{ref}} \\ e_{\omega_s} \\ \omega_s \end{bmatrix} = \begin{bmatrix} \left(-\frac{R_s}{L_s}-\frac{K_{I_s}}{L_s}\right) & \left(-\frac{K_{emf_s}}{L_s}\right) & \left(\frac{1}{L_s T_{I_s}^{i}}\right) & \left(\frac{G_s K_{I_s}}{L_s}\right) & 0 & 0 \\ \frac{K_{T_s}}{J_s} & -\frac{b_s}{J_s} & 0 & 0 & 0 & 0 \\ -1 & 0 & 0 & G_s & 0 & 0 \\ \left(-\frac{K_{T_s}}{J_s}\right)\left(\frac{K_{\omega_s}K_{TI}}{T_{\omega_s}^{f}}\right)(T_{\omega_s}^{f}+T_{\omega_s}^{d}) & \begin{bmatrix} \left(-\frac{K_{\omega_s}K_{TI}}{T_{\omega_s}^{f}}\right)\left(1+\frac{T_{\omega_s}^{f}}{T_{\omega_s}^{i}}\right)+ \\ \left(-\frac{b_s}{J_s}\right)\left(\frac{K_{\omega_s}K_{TI}}{T_{\omega_s}^{f}}\right)(T_{\omega_s}^{f}+T_{\omega_s}^{d}) \end{bmatrix} & 0 & \left(-\frac{1}{T_{\omega_s}^{f}}\right) & \left(\frac{K_{\omega_s}K_{TI}}{T_{\omega_s}^{i}T_{\omega_s}^{f}}\right) & 0 \\ 0 & -1 & 0 & 0 & 0 & 0 \\ 0 & 1 & 0 & 0 & 0 & 0 \end{bmatrix} \begin{bmatrix} I_s \\ \omega_s \\ \int e_{I_s} \\ I_{s_{ref}} \\ \int e_{\omega_s} \\ \theta_s \end{bmatrix} +$$

-continued $$\begin{bmatrix} 0 & 0 & 0 \\ 0 & -\frac{1}{J_s} & -\frac{1}{J_s} \\ 0 & 0 & 0 \\ \left(\frac{K_{\omega_s} K_{TI}}{T^f_{\omega_s}}\right)\left(1+\frac{T^f_{\omega_s}}{T^i_{\omega_s}}\right) & 0 & 0 \\ 1 & 0 & 0 \\ 0 & 0 & 0 \end{bmatrix} \begin{bmatrix} \omega^d_s \\ T_s \\ f_s \end{bmatrix}$$

The describing function gains $G_s$ appears as an element in drive system and input matrices which is recalculated at each time step. The input to the current limiter is the swing reference armature current state $I_{s_{ref}}$.

The swing armature current saturation limits can be determined from the swing joystick position.

It is to be noted that to be effective the Stage 1 and Stage 2 models should contain so-called 'shaping stages' that accommodate bias in sensors and account for physical artefacts such as transmission backlash.

It is to be noted that the Stage 2 model can also be implemented by the use of so-called Ornstein-Uhlenbeck stochastic process whose parameters may be determined from subsequent autocorrelation analysis.

Measurement Models

Given the position $(x_a, y_a, z_a)$ of the $n^{th}$ GPS antenna in the h-frame, Eqn. 12 expresses the GPS measurement made in the g-frame in terms of the position of the shovel carbody $(x_c, y_c, z_c)$ and the direction cosine matrices $R_{c2g}$ and $R_{h2c}$, describing the 3D rotations between the c- and g-, and the h- and c-frames, respectively. These matrices can be calculated in a number of ways, e.g. Euler angles or quaternions. The parameters describing these matrices are states of the estimator.

$$z_{gps}(x_c, y_c, z_c)^T + R_{c2g} R_{h2c} (x_a, y_a, z_a)^T \tag{12}$$

GPS measurements are based around an approximation of the Earth's surface in the form of a bi-axial ellipsoid. The dimensions of this ellipsoid are defined by one of several standards or datums. FIG. 2 shows the WGS84 ellipsoid approximation 20 of the earth in which the latitude, longitude and altitude of the GPS antenna are expressed. The methodology used to transform the sensor reading from the GPS receivers, measured in e-frame latitude, longitude, and altitude, into coordinates in the g-frame is as follows The first stage is to convert the measurements into Cartesian coordinates with the origin at the centre of the Earth, with the x-axis defined at the longitude value of 0° (as can be seen above in FIG. 2).

Vanicek (1986) defines that for any point, $p_0$ on the ellipsoid approximation:

$$p_0 = N_0 \cos \phi_0$$

Where $N_0$ is the distance from the centre of the ellipsoid, and $\phi_0$ is the angle from the $x_e$-$y_e$ plane (the latitude at point $p_0$). The distance from the centre of the ellipsoid is defined as:

$$N_0 = \frac{a^2}{(a^2\cos^2\phi_0 + b^2\sin^2\phi_0)^{\frac{1}{2}}} \tag{13}$$

These equations can be re-arranged to give the position vector $r_0^G$, of the point $p_0$, in global Cartesian coordinates:

$$r_0^G = \begin{bmatrix} x_0 \\ y_0 \\ z_0 \end{bmatrix} = N_0 \begin{bmatrix} \cos\phi_0 \cos\lambda_0 \\ \cos\phi_0 \sin\lambda_0 \\ (b_2/a^2)\sin\phi_0 \end{bmatrix} \tag{14}$$

Where $\lambda_0$ is the longitude at the point $p_0$.

In order to transform this global position into a local coordinate frame, a suitable local frame must first be defined. We define a set of axes centred at the point $p_0$ such that the y-axis is tangential to the surface of the ellipsoid, and points in the direction that would appear to face North to an observer standing at $p_0$. If we define this direction as "Apparent North", then "Apparent East" is the vector which is tangential to the ellipsoid's surface, and orthogonal to both the vector $r_0^G$ and the vector Apparent North. This can then define a suitable local coordinate frame, with the y-axis aligned with Apparent North, the x-axis aligned with Apparent East and the z-axis representing the height above the surface of the ellipsoid. This formulation holds for any point $p_0$ such that $\lambda_0 \neq \pm 90°$. If $\lambda_0 = \pm 90$, the direction of the x- and y-axes is arbitrary as long as they are orthogonal and form a plane which is tangential to the surface of the ellipsoid.

The local x-axis (apparent East) can be thought to have a latitude (relative to $p_0$) of zero. If we represent this axis as the unit vector of vector $r_a$, we can arbitrarily set $y_a$ to one, and use Equation 14 to give:

$$r_a = \begin{bmatrix} x_a \\ y_a \\ z_a \end{bmatrix} = \begin{bmatrix} -y_0/x_0 \\ 1 \\ 0 \end{bmatrix}. \tag{15}$$

The local y-axis (apparent North) can then be found by the requirement of being orthogonal to both the local x and z-axes:

$$r_b = r_G \times r_a \tag{16}$$

Finally, the transformation matrix from global to local coordinates can be defined as:

$$T = \begin{bmatrix} \hat{x}_a & \hat{y}_a & \hat{z}_a \\ \hat{x}_b & \hat{y}_b & \hat{z}_b \\ \hat{x}_G & \hat{y}_G & \hat{z}_G \end{bmatrix}, \tag{17}$$

-continued where $$\hat{r} = \begin{bmatrix} \hat{x} \\ \hat{y} \\ \hat{z} \end{bmatrix}.$$

This gives the final transformation from global to local coordinates for a point $p_n$ as:

$$p_n^{local} = T \cdot (p_n^{global} - r_0^G). \tag{18}$$

The pitch and roll inclinations of the machine house, as measured by the inclinometer, are determined as the angle between unit vectors in the $x_h$- and $y_h$-axes and the $(x_g, y_g)$ plane. Expressing the rotation of the c-frame relative to the g-frame as the Euler angles $(\phi_c, \theta_c, \phi_c)$, using the standard Z-X-Z rotation convention, the pitch ($\alpha$) and roll ($\beta$) angles are $$\alpha = \sin^{-1}(\sin\theta_c \sin\phi_c) \tag{19}$$

$$\beta = \sin^{-1}(\sin\theta_c \cos\phi_c) \tag{20}$$

Raw inclinometer measurements may be improved by factoring away accelerations of the sensor.

The acceleration of the IMU will be measured as the global acceleration of its location in the machine house, $(x_i, y_i, z_i)$, rotated to be aligned with the orthogonal sensor axes. Given the position of the shovel carbody $(x_c, y_c, z_c)$ and the direction cosine matrices $R_{c2g}$ and $R_{h2c}$, describing the 3D rotations between the c- and g-, and the h- and c-frames, respectively, the acceleration measurements are $$z_{acc} = R_{g2c} R_{c2h} a_i \tag{21}$$

Where the acceleration of the IMU in the g-frame is found from $$a_i = \frac{d^2}{dt^2}((x_c, y_c, z_c)^T + R_{h2c} R_{c2g}(x_i, y_i, z_i)^T) \tag{22}$$

The g-frame is assumed to be non-accelerating and non-rotating.

The angular velocity of the IMU will be measured as the global angular velocity of the machine house, rotated to be aligned with the orthogonal sensor axes. Expressing the rotation of the h-frame relative to the c-frame as the Euler angles $(\phi_h, \theta_h, \phi_h)$, using the standard Z-X-Z rotation convention, the measured angular velocities about the RPY axes are $$Z_{ang} = \begin{bmatrix} \sin(\varphi_h)\sin(\theta_h) \\ \cos(\varphi_h)\sin(\theta_h) \\ \cos(\theta_h) \end{bmatrix} \dot{\phi}_h + \begin{bmatrix} \cos(\varphi_h) \\ -\sin(\varphi_h) \\ 0 \end{bmatrix} \dot{\theta}_h + \begin{bmatrix} 0 \\ 0 \\ 1 \end{bmatrix} \dot{\varphi}_h \tag{23}$$

Stage 3 Calculations for P&H-Class Machines

Figure 6:
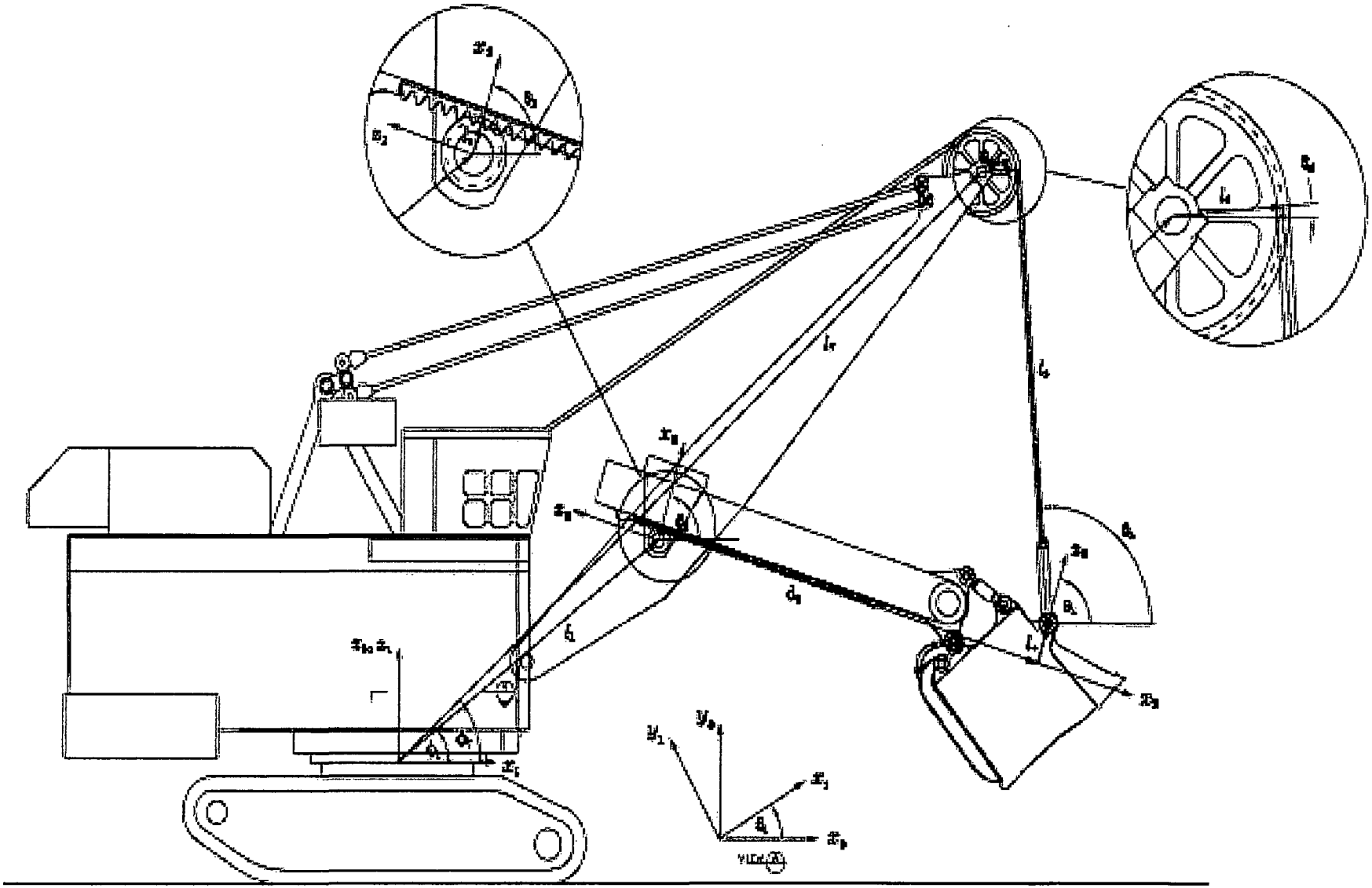
FIG. 6 illustrates coordinate systems for P&H-class electric mining shovels.

The Stage 3 calculations are dependent on the machine in question. In the preferred embodiment the calculations have been carried out for a P&H-class mining shovels FIG. 6 shows the parameters (lengths and angles) used to describe the geometry of P&H-class electric mining shovels and the coordinate frames used to describe relative positions of major moving assemblies of these machines. Lengths labeled l and angles labeled $\phi$ are fixed by design; length labeled d and angles labeled $\theta$ vary under machine motion. This geometry is needed to determine the location of the bucket relative to the h-frame.

The c-frame is denoted $O_c x_c y_c z_c$; the h-frame is denote $O_h x_h y_h z_h$ and is embedded in the machine house; the $O_m x_m y_m z_m$-m-frame in the saddle; and the $O_b x_b y_b z_b$ b-frame in the dipper. The x- and z-axes of all the body-fixed frames are in the sagittal plane of the machine house, that is the plane parallel to the plane of projection shown in FIG. 6 containing the swing axis. The y-axes of all frames are normal to this plane.

Four-by-four homogeneous transformation matrices can be used to describe the relationship between frames. We denote the matrix describing the transform from $O_i x_i y_i z_i$ to $O_i x_i y_i z_i$ by $D_{i\to j}$ and note that the action of this matrix maps (homogeneous) points in the j-frame to the i-frame. For instance, if p is a point whose location is known in $O_b x_b y_b z_b$, fixed in the bucket, then the coordinates of that point in frame $O_c x_c y_c z$, can be found from.

$$p' = D_{0\to 3} p.$$

The structure of $D_{i\to j}$ is $$D_{i\to j} = \begin{pmatrix} R_{i\to j} & t_{i\to j} \\ 0 & 1 \end{pmatrix}$$

where $R_{i\to j}$ is a 3×3 rotation matrix and $t_{i\to j}$ is a 3-dimensional translation vector. Four-by-four homogeneous transformation matrices commute according to $$D_{i\to k} = D_{i\to j} D_{j\to k}.$$

The origin of the c-frame is located at the interface between the upper surface of the tracks and the underside surface of the machine house. The $z_c$-axis collinear with the swing axis. The $x_c$-axis points in the direction of forward travel of the crawler tracks, and the $y_c$-axis completes a right-handed trihedral coordinate frame.

The origin $O_h$ of frame $O_h x_h y_h z_h$ is coincident with $O_c$ and $z_h$ is collinear with $z_c$. When $\theta_1 = 0$, frames $O_c x_c y_c z_c$ and $O_h x_h y_h z_h$ coincide. A positive angle $\theta_1$ corresponds to an anti-clockwise rotation of the machine house relative to the tracks when viewed from above. The homogeneous transformation matrix $D_{c\to h}$ is given by $$D_{0\to 1} = \begin{pmatrix} \cos\theta_1 & -\sin\theta_1 & 0 & 0 \\ \sin\theta_1 & \cos\theta_1 & 0 & 0 \\ 0 & 0 & 1 & 0 \\ 0 & 0 & 0 & 1 \end{pmatrix}.$$

Frame $O_m x_m y_m z_m$ is fixed to the saddle with $O_2$ at the center of rotation of the saddle. When $\theta_2$ is equal to 0, the coordinate directions of $O_m x_m y_m z_m$ are parallel to those of $O_h x_h y_h z_h$. The displacement matrix describing the rigid body displacement from Frame h to Frame n is given by $$D_{h\to m} = \begin{pmatrix} \cos\theta_2 & 0 & -\sin\theta_2 & l_1\cos\phi_1 \\ 0 & 1 & 0 & 0 \\ \sin\theta_2 & 0 & \cos\theta_2 & l_1\sin\phi_1 \\ 0 & 0 & 0 & 1 \end{pmatrix},$$

where design parameters $l_1$ and $\phi_1$ are as shown in FIG. 6.

The origin $O_b$ of $O_b x_b y_b z_b$ is located as follows. The saddle angle ($\theta_2$) is set equal to 90 degrees so that the handle is horizontal. The handle is then displaced such that the hoist rope falls vertically ($\theta_5$=90 degrees and $\theta_6$=0 degrees). The origin $O_b$ is located at the intersection of the pitch-line of the handle-rack and the hoist rope; $z_b$ is set to be collinear with the axis of the hoist rope; $x_b$ is set parallel to the pitch-line of the handle-rack. Note that axis $x_m$ is orthogonal to axis $x_b$. The displacement matrix describing the rigid body displacement $D_{m\to b}$ is given by $$D_{2\to 3} = \begin{pmatrix} 0 & 0 & 1 & l_2 \\ 0 & 1 & 0 & 0 \\ -1 & 0 & 0 & -d_3 \\ 0 & 0 & 0 & 1 \end{pmatrix}.$$

The multiplication of the above Eqns gives:

$$D_{c\to b} = D_{c\to h} D_{h\to m} D_{m\to b}$$

$$= \begin{pmatrix} \cos\theta_1 \sin\theta_2 & -\sin\theta_1 & \cos\theta_1\cos\theta_2 & \cos\theta_1 \begin{pmatrix} l_1\cos\phi_1 + \\ l_2\cos\theta_2 + \\ d_3\sin\theta_2 \end{pmatrix} \\ \sin\theta_1\sin\theta_2 & \cos\theta_2 & \sin\theta_1\cos\theta_2 & \sin\theta_1\theta_1 \begin{pmatrix} l_1\cos\phi_1 + \\ l_2\cos\theta_2 + \\ d_3\sin\theta_2 \end{pmatrix} \\ -\cos\theta_2 & 0 & \sin\theta_2 & \begin{matrix} l_1\sin\phi_1 + \\ l_2\sin\theta_2 - \\ d_3\cos\theta_2 \end{matrix} \\ 0 & 0 & 0 & 1 \end{pmatrix}.$$

The swing angle, $\theta_1$, the pivot angle, $\theta_2$, and the crowd extension, $d_3$, parameterize the displacement and rotation of the body fixed frames relative to the world frame. These configuration variables can be grouped as follows:

$$\theta=(\theta_1,\theta_2,d_3)^T.$$

The displacements of the swing motor $\theta_s$, crowd motor $\theta_c$, and hoist motor $\theta_h$ can be similarly grouped:

$$\psi=(\theta_s,\theta_c,\theta_h)^T.$$

The values of $\theta$ determine $\psi$ and vice versa. These mappings are not bijective. However, within the physical working range of these variables their correspondence is one-to-one. Note that the specification of either $\theta$ or $\psi$ determines the inclination of the hoist rope, a seventh variable, labeled $\theta_5$ in FIG. 6.

To build up the constraint equations, start by noting the dependent coordinates $\theta_s$ and $\theta_c$ are related $\theta_1$ and $d_3$ by transmission ratios leading to $$0 = \gamma_1(\theta, \psi) = \begin{bmatrix} G_s\theta_1 - \theta_s(42) \\ G_c d_3 - \theta_c \end{bmatrix}, \tag{23a}$$

where $G_s$ is the transmission ratio of the swing drive and $G_c$ is the transmission ratio of the crowd drive.

The constraint equations relating $\theta_2$ and $\theta_5$ to $\theta_c$ and $\theta_h$ can be developed using the vector loop shown in FIG. 6. To simplify the notation, we work in a complex plane mapped to the physical $(x_1,z_1)$-plane with the real axis collinear with x, and imaginary axis with $z_1$.

Figure 7:
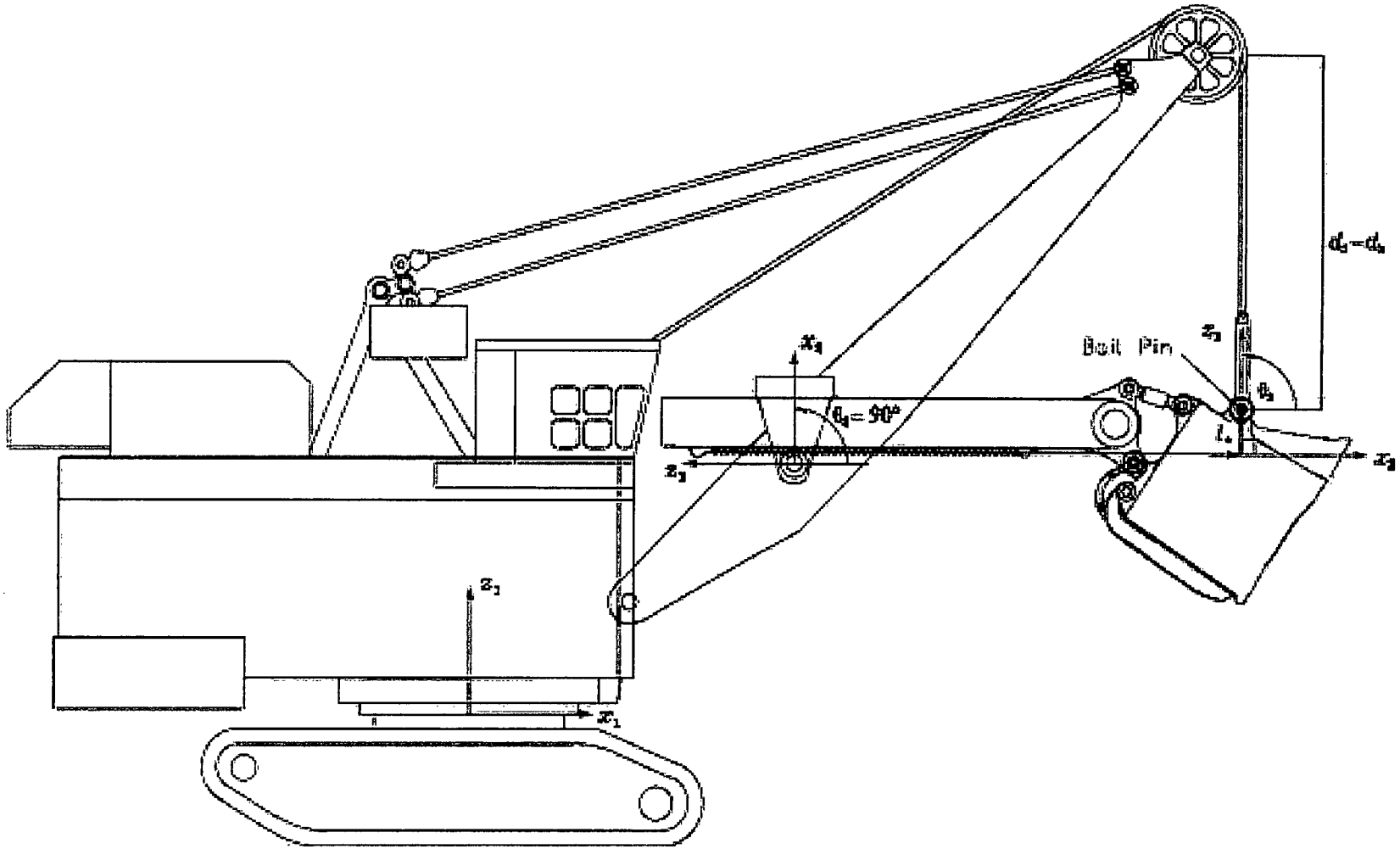
FIG. 7 illustrates a P&H-class electric mining shovel in the right angle configuration for the purpose of defining the b-frame.

Summing vectors in the vector loop of FIG. 6 where the vector $z_i$ is expressed as a complex variable gives $$0=\zeta(\theta,\psi,\theta_5)=z_1+z_2+z_3+z_4+z_5-z_6-z_7,$$

which can be expanded to give, $$0=\zeta(\theta,\psi,\theta_5)=l_1e^{i\phi_1}+l_2e^{i\theta_2}+d_2e^{i(\theta_2-\pi 2)}+ l_4e^{i\theta_4}+d_5e^{i\theta_5}-l_6e^{i\theta_6}-l_7e^{i\phi_7}. \tag{24}$$

where the variables $l_i$, $d_i$, $\theta_i$ and $\phi_i$ are as defined in FIG. 7. Then using the following relations determined by inspection, $$\theta_6 = \theta_5 - \frac{\pi}{2}, \qquad \theta_4 = \theta_2, \tag{25}$$

Eqn. 24 can be written as, $$\zeta(\theta,\psi,\theta_5)=l_1e^{i\phi_1}+l_2e^{i\theta_2}+d_3e^{i(\theta_2<\pi 2)}+ l_4e^{i\theta_2}+d_5e^{i\theta_5}-l_6e^{i(\theta_5-\pi 2)}-l_7e^{i\phi_7}. \tag{26}$$

To remove $d_5$ from this equation it is convenient to first introduce the variable $d_h$. As shown in FIG. 6, $d_h$ represents the distance from the bail pin to the outer quadrant of the hoist sheave when the hoist rope hangs vertically (i.e. $\theta_5$=90 deg). It is related to the angular displacement of the hoist motor by, $$d_h = \frac{\theta_h}{G_h},$$

where $G_h$ is the hoist transmission ratio. The above expression and Equation 25 can be used to relate $d_5$ and $d_h$, $$d_5 = d_h + l_6\theta_6 = \frac{\theta_h}{G_h} + l_6\left(\theta_5 - \frac{\pi}{2}\right). \tag{27}$$

The last term on the right hand side of Eqn. 27 accounts for the angle of wrap of the hoist rope around the sheave. Substituting Eqn. 27 into Eqn. 26 gives $$\zeta(\theta, \psi, \theta_5) = l_1e^{i\phi_1} + l_2e^{i\theta_2} + d_3e^{i(\theta_2-\pi 2)} + l_4e^{i\theta_2} + \begin{bmatrix} \frac{\theta_h}{G_h} + \\ l_6\left(\theta_5 - \frac{\pi}{2}\right) \end{bmatrix} e^{i\theta_5} - l_6e^{i\left(\theta_5-\frac{\pi}{2}\right)} - l_7e^{i\phi_7} = 0. \tag{28}$$

Taking the real and imaginary components of Eqn. 28 relates $\theta_h$ and $\theta_5$ to the generalized coordinates, $$\gamma_2(\theta, \psi, \theta_5) = \begin{bmatrix} l_1\cos\phi_1 + l_2\cos\theta_2 + d_3\sin\theta_2 + l_4\cos\theta_2 + \begin{bmatrix} \frac{\theta_h}{G_h} + \\ l_6\left(\theta_5 - \frac{\pi}{2}\right) \end{bmatrix}\cos\theta_5 - l_6\sin\theta_5 - l_7\cos\phi_7 \\ l_1\sin\phi_1 + l_2\sin\theta_2 - d_3\cos\theta_2 + l_4\sin\theta_2 + \begin{bmatrix} \frac{\theta_h}{G_h} + \\ l_6\left(\theta_5 - \frac{\pi}{2}\right) \end{bmatrix}\sin\theta_5 + l_6\cos\theta_5 - l_7\sin\phi_7 \end{bmatrix}. \tag{29}$$

Note that use has been made of the following trigonometric relationships in arriving at Eqn. 29, $$\cos\left(\theta_i - \frac{\pi}{2}\right) = \sin\theta_i,$$

$$\sin\left(\theta_i - \frac{\pi}{2}\right) = -\cos\theta_i.$$

Concatenating Eqns. 23a and 29 gives $$0 = \Gamma(\theta, \psi, \theta_5) \tag{30}$$

$$= \begin{bmatrix} G_s\theta_1 - \theta_s \\ G_c d_3 - \theta_c \\ l_1\cos\phi_1 + l_2\cos\theta_2 + d_3\sin\theta_2 + l_4\cos\theta_2 + \begin{bmatrix} \frac{\theta_h}{G_h} + \\ l_6\left(\theta_5 - \frac{\pi}{2}\right) \end{bmatrix}\cos\theta_5 - l_6\sin\theta_5 - l_7\cos\phi_7 \\ l_1\sin\phi_1 + l_2\sin\theta_2 - d_3\cos\theta_2 + l_4\sin\theta_2 + \begin{bmatrix} \frac{\theta_h}{G_h} + \\ l_6\left(\theta_5 - \frac{\pi}{2}\right) \end{bmatrix}\sin\theta_5 + l_6\cos\theta_5 - l_7\sin\phi_7 \end{bmatrix}.$$

Kinematic Tracking by Newton-Raphson

The kinematic tracking problem is to determine the values of $\theta$ and $\theta_5$ given $\psi$ or to determine $\psi$ and $\theta_5$ given $\psi$. We call the first problem forward kinematic tracking and the second inverse kinematic tracking. For notational convenience in distinguishing between these two problems, we write $$\theta_F = (\theta_1, \theta_2, \theta_3, \theta_5)$$

$$\psi_F = (\theta_s, \theta_c, \theta_h)$$

when working in the domain of the forward kinematic tracking problem and $$\theta_I = (\theta_1, \theta_2, \theta_3)$$

$$\psi_I = (\theta_s, \theta_c, \theta_h, \theta_5)$$

The difference here is in with the grouping of $\theta_5$. Both problems amount mathematically to solving the non-linear constraint equations. We chose to do this iteratively using a multi-variable Newton's method. The Jacobian matrices developed in expressing a Newton's method solution are used to refer motor inertias to the configuration variables and to solve the statics problem.

Forward Kinematic Tracking

Applying Taylor's series expansion to Eqn 30

$$\Gamma(\theta_F + \Delta\theta_F, \psi_F + \Delta\psi_F) = \Gamma(\theta_F, \psi_F) + \frac{\delta\Gamma(\theta_F, \psi_F)}{\delta\theta_F}\Delta\theta_F + \frac{\delta\Gamma(\theta_F, \psi_F)}{\delta\psi_F}\Delta\psi_F + \text{HOT} = 0.$$

The objective is to find a valid configuration, i.e. $\Gamma(\theta_F+\Delta\theta_F, \psi_F+\Delta\psi_F)=0$. It follows that $$\Gamma(\theta_F, \psi_F) \approx -\begin{bmatrix} \frac{\delta\Gamma(\theta_F, \psi_F)}{\delta\theta_F}\Delta\theta_F + \\ \frac{\delta\Gamma(\theta_F, \psi_F)}{\delta\psi_F}\Delta\psi_F \end{bmatrix}$$

This leads to the iteration equation $$\Delta\theta_F^k = -\left(\frac{\partial\Gamma(\theta_F^{k-1}, \psi_F^k)}{\partial\theta_F}\right)^{-1}\begin{pmatrix} \Gamma(\theta_F^{k-1}, \psi_F^k) + \\ \frac{\partial\Gamma(\theta_F^{k-1}, \psi_F^k)}{\partial\psi_F}\Delta\psi_F^k \end{pmatrix} \tag{31}$$

with $$\theta_F^k = \theta_F^{k-1} + \Delta\theta_F^k \tag{32}$$

The algorithm below, gives an algorithm for kinematic tracking for P&H-class shovels. The algorithm takes the current motor positions, $\psi_F^k$ and uses Eqns. 31 and 32 to find the new values of $\theta_F^k$ consistent with the constraint equations. For reliable convergence the algorithm requires a good initial values $\theta_F^0$. In practice this can be achieved by initializing from a well defined configuration such as provided in FIG. 6 where the forward kinematics can be explicitly solved using trigonometry.

---

Algorithm 3: Forward kinematic tracking using Newton's method

--- input: Current motor position $\psi_F^k$.
output: Values of configuration variables $\theta_F^k$ consistent with the constraint equations.
priors: Previous motor and configuration variables: $\theta_F^{k-1}$, $\psi_F^{k-1}$.
Initialization:
$\Delta\psi_F^k = \psi_F^k - \psi_F^{k-1}$
$\theta_F^k = \theta_F^{k-1}$
$\Gamma_F = \Gamma(\theta_F^k, \psi_F^k)$
Iterate until converged:

$$\|\Gamma_F\| < \text{tol}\ \Delta\theta_F^k = -\left(\frac{\partial\Gamma(\theta_F^k, \psi_F^k)}{\partial\theta_F}\right)^{-1}\left(\Gamma(\theta_F^k, \psi_F^k) + \frac{\partial\Gamma(\theta_F^k, \psi_F^k)}{\partial\psi_F}\Delta\psi_F^k\right)$$

$\theta_F^k = \theta_F^k + \Delta\theta_F^k$
$\Gamma_F = \Gamma(\theta_F^k, \psi_F^k)$

---

It can be seen that the preferred embodiments provide an accurate method for maintaining a close approximation of the shovel position at all times.

Although the invention has been described with reference to specific examples it will be appreciated by those skilled in the art that the invention may be embodied in many other forms.

We claim:

1. A method of determining the global pose of a mining shovel, the mining shovel including:

a machine shovel carbody substantially static between digging operations;

a machine house that is mounted on the carbody and rotatable about a vertical axis relative to the carbody;

a shovel assembly including a shovel handle and a bucket assembly, the shovel assembly being mounted to the machine house, and movable relative to the machine house;

the method including:

(a) as a first stage computing the location of the mining shovel carbody (c-frame) relative to a local geodetic frame (g-frame) using a global positioning system, an inclinometer, and a swing axis resolver;

(b) as a second stage computing a house pose (h-frame) relative to the c-frame using a global positioning system, an axis inertial sensor and a swing axis resolver;

(c) as a third stage computing a bucket pose (b-frame) relative to the h-frame using crowd and hoist axis resolvers.

2. A method as claimed in claim 1 wherein (a) and (b) are carried out using an extended Kalman filter.

3. A method as claimed in claim 1 wherein (a) is carried out using an iterative routine until convergence.

4. A method as claimed in claim 1 wherein the inclinometer is a twin axis inclinometer.

5. A method as claimed in claim 1 wherein the inertial sensor is a six axis inertial sensor.

6. A method as claimed in claim 2 wherein (a) is carried out using an iterative routine until convergence.

7. A method as claimed in claim 2 wherein the inclinometer is a twin axis inclinometer.

8. A method as claimed in claim 2 wherein the inertial sensor is a six axis inertial sensor.

9. A method as claimed in claim 3 wherein the inertial sensor is a six axis inertial sensor.

10. A method as claimed in claim 4 wherein the inertial sensor is a six axis inertial sensor.

11. A method as claimed in claim 6 wherein the inertial sensor is a six axis inertial sensor.

12. A method as claimed in claim 7 wherein the inertial sensor is a six axis inertial sensor.

* * * * *

UNITED STATES PATENT AND TRADEMARK OFFICE

CERTIFICATE OF CORRECTION

PATENT NO. : 8,571,762 B2
APPLICATION NO. : 12/812186
DATED : October 29, 2013
INVENTOR(S) : Peter Ross McAree and Anthony Walton Reid It is certified that error appears in the above-identified patent and that said Letters Patent is hereby corrected as shown below:

Title page, item (54) and in the Specifications, Column 1
--Title should be "Real Time Method for Determining the Spatial Pose of Electric Mining Shovels"

Signed and Sealed this
Seventeenth Day of December, 2013

Margaret A. Focarino

Margaret A. Focarino
*Commissioner for Patents of the United States Patent and Trademark Office*